US006891120B2

(12) United States Patent
Ren

(10) Patent No.: US 6,891,120 B2
(45) Date of Patent: May 10, 2005

(54) MULTIPOLAR INTEGRATED CONTACT FOR POWER SWITCHGEAR

(75) Inventor: Jianchang Ren, Beijing (CN)

(73) Assignee: Bo Technology Group Co., Ltd., Beijing (CN)

( * ) Notice: Subject to any disclaimer, the term of this patent is extended or adjusted under 35 U.S.C. 154(b) by 0 days.

(21) Appl. No.: 10/648,607

(22) Filed: Aug. 25, 2003

(65) Prior Publication Data

US 2004/0035827 A1 Feb. 26, 2004

Related U.S. Application Data

(63) Continuation of application No. PCT/CN01/01512, filed on Oct. 29, 2001.

(30) Foreign Application Priority Data

Feb. 28, 2001 (CN) ..... 01109232 A

(51) Int. Cl.[7] ..... H01H 33/66
(52) U.S. Cl. ..... 218/127; 218/123
(58) Field of Search ..... 218/118, 123–133

(56) References Cited

U.S. PATENT DOCUMENTS 4,117,288 A * 9/1978 Gorman et al. ..... 218/129
4,935,588 A * 6/1990 Hess et al. ..... 218/123
5,055,639 A * 10/1991 Schels et al. ..... 218/129
5,059,752 A 10/1991 Inagaki
5,557,083 A * 9/1996 Komuro et al. ..... 218/123
5,777,287 A * 7/1998 Mayo ..... 218/123
5,929,411 A 7/1999 Schulman

* cited by examiner

*Primary Examiner*—Lincoln Donovan

(57) ABSTRACT

A multipolar integrated contact for power switchgear, its arc proof component, magnetic field generating component and conductive component are set in a container with top opened. Conductive component and magnetic field generating component are mutually combined and set at the bottom of the container, arc proof component is set on top of the combination of conductive component and magnetic field generating component. Conductive component passes through center of the container, and from top to down, it equally divides the container; magnetic field generating component is isolated by conductive component and set at other part of the container. Contact surface of the invention has multipolar axial magnetic field, the contact is suitable used for integrated contact for interrupting high volume current in arc extinguished chamber of vacuum interrupter. The invention belongs to electrical equipment field.

18 Claims, 9 Drawing Sheets

MULTIPOLAR INTEGRATED CONTACT FOR POWER SWITCHGEAR

This application is a continuation of international application PCT/CN01/01512 filed on Oct. 29, 2001, which claims the priority benefit of Chinese application No. 01109232.7 filed on Feb. 28, 2001.

FIELD OF THE INVENTION

The present invention relates to a structure of an integrated contact for power switchgear, especially a structure of an integrated contact in an arc extinguished chamber of a vacuum interrupter. It belongs to electrical equipment field.

BACKGROUND OF THE INVENTION

Switchgear is an essential equipment in circuit which plays switching on and switching off function in the circuit. While switching off, switchgear has very high resistance in order to withstand certain voltage; While switching on, it must have very low resistance in order to pass rated current without overheat. During switchgear contacts interrupting, arc extinguishing is necessary to make contacts to be quickly separated. At present, there are different kinds of arc extinguishing medium: oil, sulphur hexafluride($SF_6$), air, semiconductor and vacuum etc. Different arc extinguishing mediums correspond to different interrupter structures and with different properties. As vacuum interrupter has small gap, high withstand voltage, low arc voltage, high current interrupting capability, low electrode erosion and high electric life, so it is broadly used in power line under 35 KV voltage. As shown in FIG. 1, the heart of a vacuum interrupter 7 is its vacuum arc extinguished chamber 6 within envelope 5. The properties of contacts 1 and 2 within vacuum arc extinguished chamber 6 determine properties of vacuum interrupter 7 directly. The rear of contacts 1 and 2 of vacuum interrupter 7 is connected to moving electrode 3 and stationary electrode 4, respectively, interruption of contacts 1 and 2 is mechanically operated by moving electrode 3. During interruption, contact area of contacts 1 and 2 is getting smaller until there is only one contact point between contacts 1 and 2. At the same time, contact resistance and area temperature are increased until the contact point is melted, vaporized and ionized. Metal vapor keeps discharge procedure to be continued in vacuum and produces vacuum arc, finally contacts are electrically interrupted. In order to raise interrupting capability of vacuum interrupter, it is necessary to provide vacuum arc with axial magnetic field, which maintains vacuum arc at a stable and dispersive state. In this way, current will be well distributed on contact surface, temperature on contact surface will be decreased and amount of vaporization of contact material is avoided, all of these maintaining arc voltage at a lower level and decreasing electrical erosion of contact. Therefore, contacts in arc extinguished chamber of vacuum interrupter must have abilities of burning arc, conducting electrically and producing magnetic field. Its technical parameters need to satisfy following requirements: excellent anti-welding characteristics, excellent voltage withstanding characteristics, high current-interrupting capability, excellent anti-electric erosion characteristics, low current chopping characteristics, low air content, high conductivity, small geometric size and high reliability etc. Currently, the contact consists of an arc proof component, a conductive component and a magnetic field generating component. As shown in FIG. 2, the arc proof component 11 is set in the middle part and consists of copper-chromium (CuCr) material, which has large current interrupting capability and excellent anti-welding characteristics and produces metal vapor during interrupting time to maintain current. The conductive component 12 is a round contact body and is generally made of copper material. The magnetic field generating component 13 is an inductance coil and set outside of the contact body; whether at an axial magnetic field or at a radial magnetic field, its magnetic field intensity is comparatively low. When assembled, it is necessary to solder in a vacuum and heating furnace with silver copper solder to combine the components together. As every component is complicated, one soldering step can only perform part of the soldering job; so during manufacturing, it is not only necessary to enter vacuum and heating furnace many times for soldering, but the following problems also exist which cause the contact electrical properties to be not good enough: contact of the soldering surface is not 100%, quality of soldering surface and strength of soldering have not been guaranteed and burr on soldering surface is unavoidable etc. For reasons mentioned above, with current technology, production of vacuum interrupter not only has low ratio of final product, complicated procedure, these causing high cost, but does not have ideal electrical properties either. In addition, all components need various professional forms of copper-chromium alloy materials and machining work, such as lathing and milling, of the alloy materials is complicated.

There is another product, developed by HOLEC Co., Netherlands, with current technology, its magnetic field generating component 13 discards the original coil form and substitutes it with a set of electrical iron sheets 13, which is piled on CuCr arc proof component 11 of contact body and is fasten with rivet 14. Electrical iron sheets 13 have different sizes of break 131, 132 and 133, magnetic field is produced by induced current in the electrical iron sheets, and its concrete structures are shown in FIG. 3 and FIG. 4. The piled electrical iron sheets 13 on CuCr arc proof component 11 form a ladder-shape, when it is seen from front view; this not only simplifies the original contacts structure, but also increases the magnetic field intensity greatly. Even with this structure, the soldering method must be used in order to combine the separated conductive component 12 and electrical iron sheet 13 together. As machining methods of the structure are unchanged basically, so its cost and quality still have quite a few problems. In addition, as electrical iron sheets 13 are piled in plane, according to the right-handed screw law, when magnetic induce reaches the break of sheets and goes up layer by layer to form an axial magnetic flux, so the magnetic resistance is comparatively high. Furthermore, as the sheets 13 are piled in a ladder-shaped form, the heat conductive body is an eccentric body; this asymmetrical heat conductive body makes instant heat diffusion effect badly; which not only influences contact interrupting capability, but also makes the whole structure deform easily.

No matter which form is used, a very important point for the current contact structure is that, without any exception, every component of it is separately made. Therefore, manufacturing procedures are various, the quality is unstable and the properties are not good enough. This is just like the separated electronic elements in the early days, to implement an electrical function many separated elements needed to be soldered together. This not only increases working procedures and size, but also decreases reliability and properties.

In addition to increasing costs by the complicated structure and manufacturing procedures described above, the current technology used to produce the contact wastes great quantities of contact materials. Either as shown in FIG. 2, the traditional structure, or as shown in FIG. 3 and FIG. 4, the improved structure, remaining leftover bits and pieces after manufacturing of the components cannot be rationally used. So, the cost of the vacuum interrupter is increased.

Another important point is that, with the current technology the axial magnetic field on the contact surface is not well distributed. At the same time, external stray magnetic fields influence interrupting capability of contacts. Especially for the contact of a high volume interrupter, its axial magnetic field is more concentrated on a local part and this leads to a worse interrupting capability under high volume current condition. This disadvantage is a big limitation for production of high volume vacuum interrupters. In practice, accompanying with electricity is widespread used, demand of high volume vacuum interrupter is increased rapidly; for example: an electric generator requires control of electrical currents greater than one hundred and twenty (120) kilo amps (kA), on a distributing line using a vacuum interrupter as an interrupting device.

SUMMARY OF THE INVENTION

In one embodiment, the present invention provides a multipolar integrated contact with an integrated directly assembled structure, for power switchgear. The present invention, eliminates the need of soldering for combining and it changes the separated setting structure of all components in the current technology.

In one embodiment, the invention provides a multipolar integrated contact with a tight structure and smaller geometric size, for power switchgear. A multipolar integrated contact has a high intensity magnetic field, good heat conductivity, high interrupting capacity and longer electric live, for power switchgear. The axial magnetic field is well distributed on the contact surface, which is suited for a high volume interrupter and has a greater interrupting capacity, when used for power switchgear.

DETAILED DESCRIPTION

A multipolar integrated contact is disclosed that combines contact components, which are separately set using the current technology, into a container, which acts as an external package of the contact so that the contact has an integrated whole structure. Specifically, a magnetic field generating component and a conductive component are mutually combined and set at the bottom of the container; an arc proof component is set on top of the combination of the magnetic field generating component and the conductive component. The magnetic field generating component has magnetic path open break. The combining of magnetic field generating component and conductive component produces axial magnetic field. The container can be a cup-like body, and its materials are rigid, melt point of the container is higher than the melting point of any component in the container, for example, the container material can be rustless steel whose melting point is above eleven hundred (1100) degrees Centigrade. The conductive component material can be conductive with respect to electricity and heat, and have high magnetic resistance. Pure copper or red copper material can be used, with a melting point of one thousand eighty three (1083) degrees Centigrade. In order to achieve a melting state for the conductive component in a furnace, the temperature of the furnace must be higher than one thousand eighty three (1083) degrees Centigrade. Therefore, the melting point of the container must be higher than eleven hundred (1100) degrees Centigrade. Part or all of the materials of the magnetic field generating component are soft magnetic materials, for example electric iron.

As there is a container outside the contact, the state of the arc proof component, the magnetic field generating component and the conductive component can be powder, sheet, bar, tube or block, that produce an axial magnetic field with magnetic flux coming in and going out on the contact surface.

In one embodiment, the arc proof component 84 is made of a block or a plate of an alloy material containing pure copper and pure chromium. In one embodiment, that lowers the cost of materials, for the arc proof component, an alloy material of pure copper and pure chromium is substituted with a mixture of general copper powder and chromium powder. According to different requirements, the ratio of copper powder and chromium powder can be varied from 10:90 to 90:10. In one embodiment of the invention copper powder and chromium powder of 325 meshes is preferred, and the copper powder can be substituted by silver powder.

Figure 1:
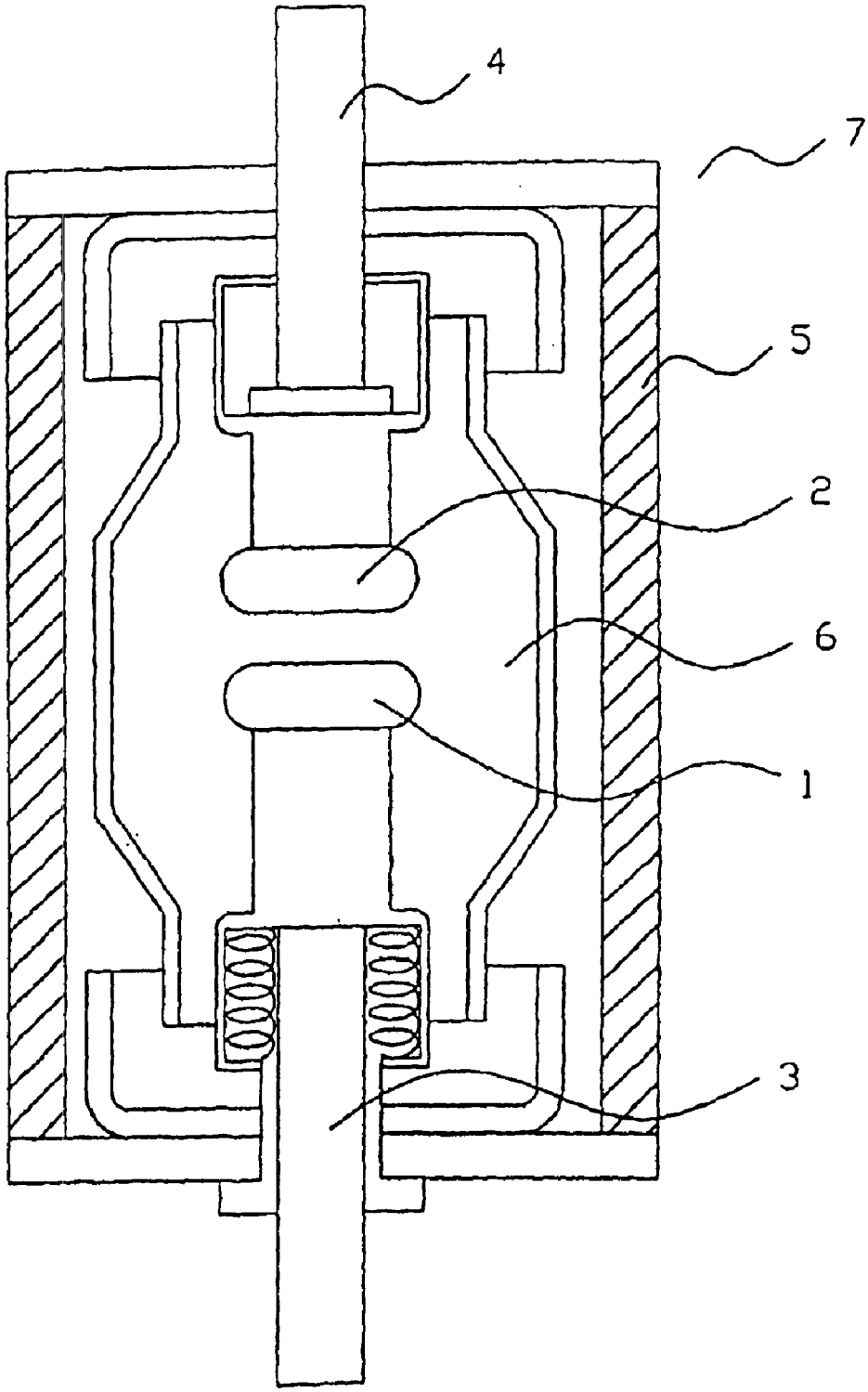
FIG. 1 is a schematic diagram of the arc extinguished chamber basic structure of present vacuum interrupter.
Figure 2:
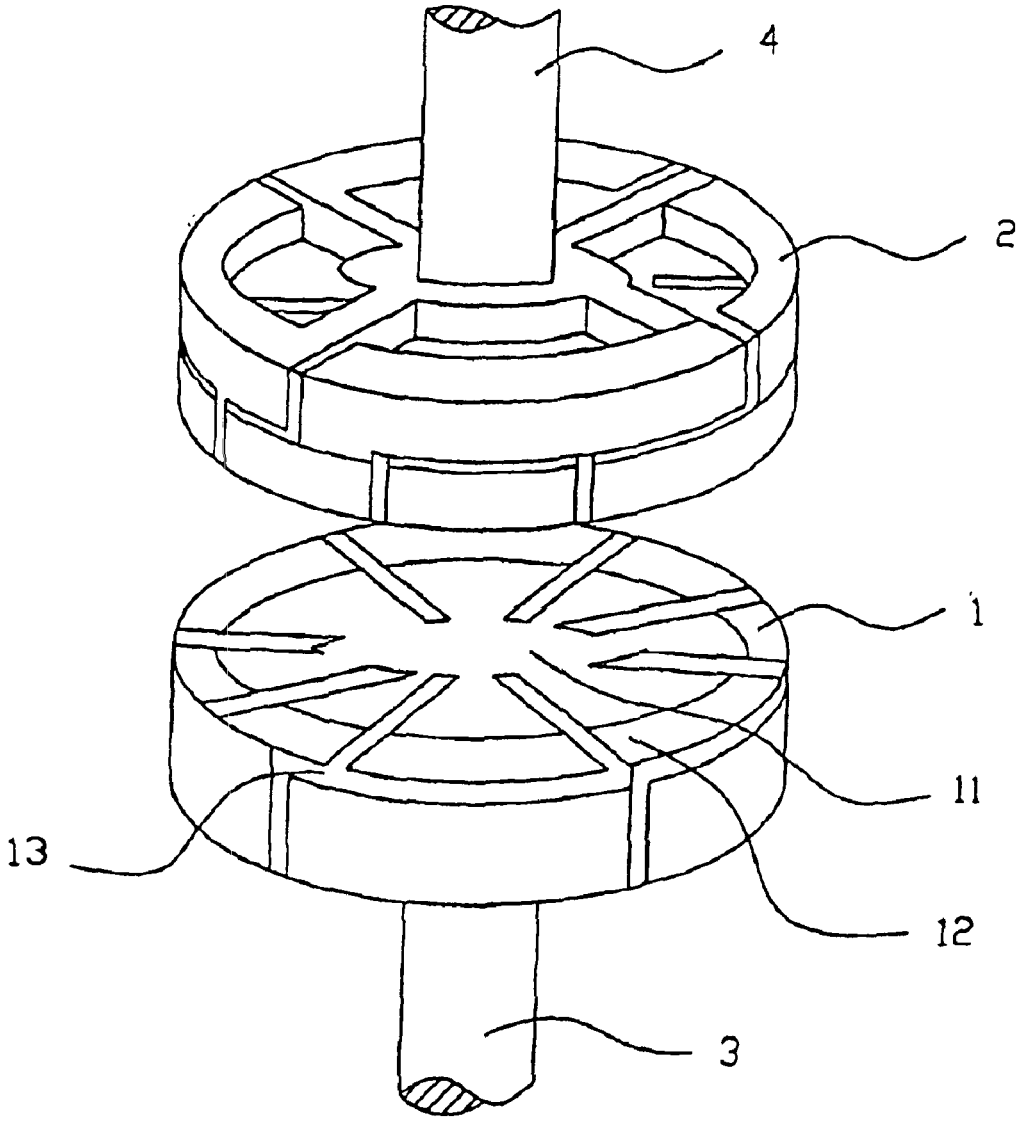
FIG. 2 is a schematic diagram of the contact structure of present arc extinguished chamber.
Figure 3:
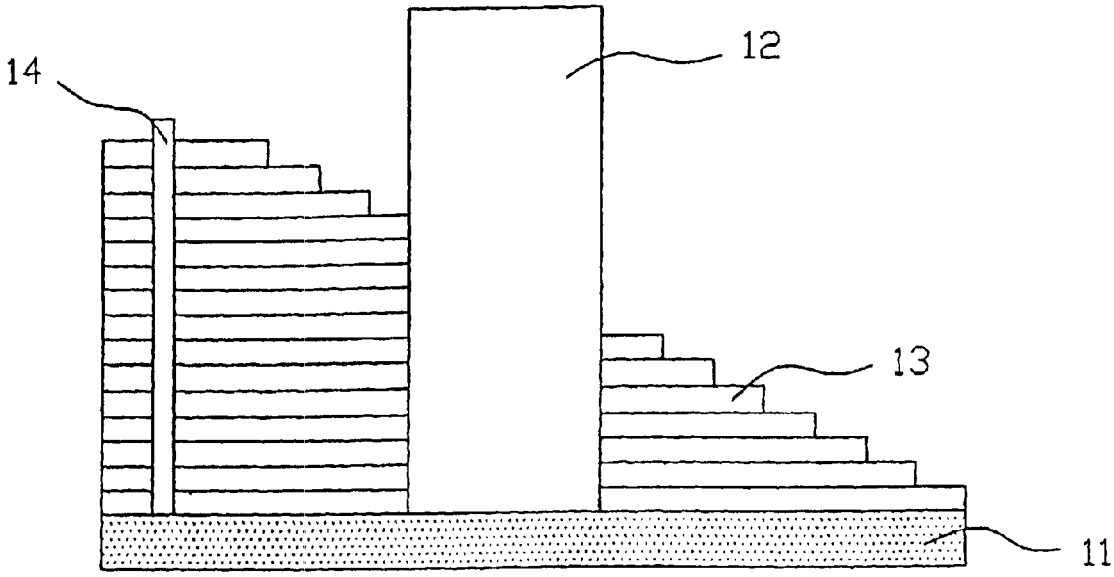
FIG. 3 is a schematic diagram of another contact structure of present vacuum interrupter.
Figure 4:
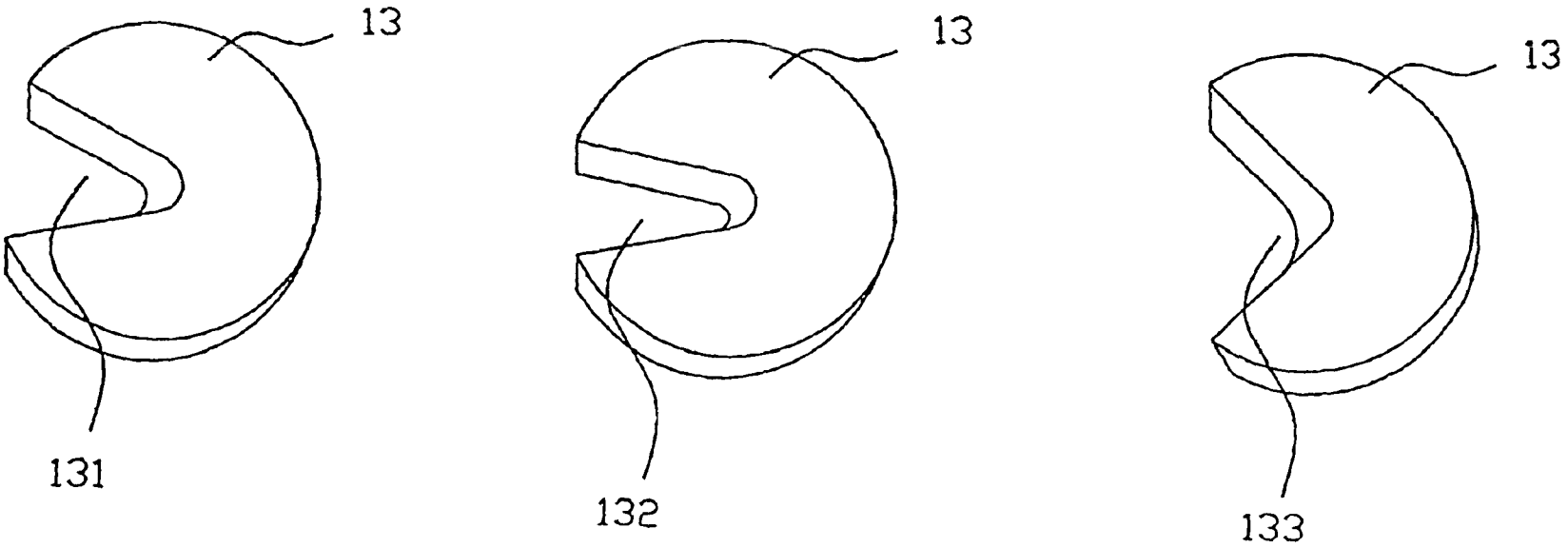
FIG. 4 is a schematic diagram of the plane structure of the magnetic field generating component shown in FIG. 3.
Figure 5:
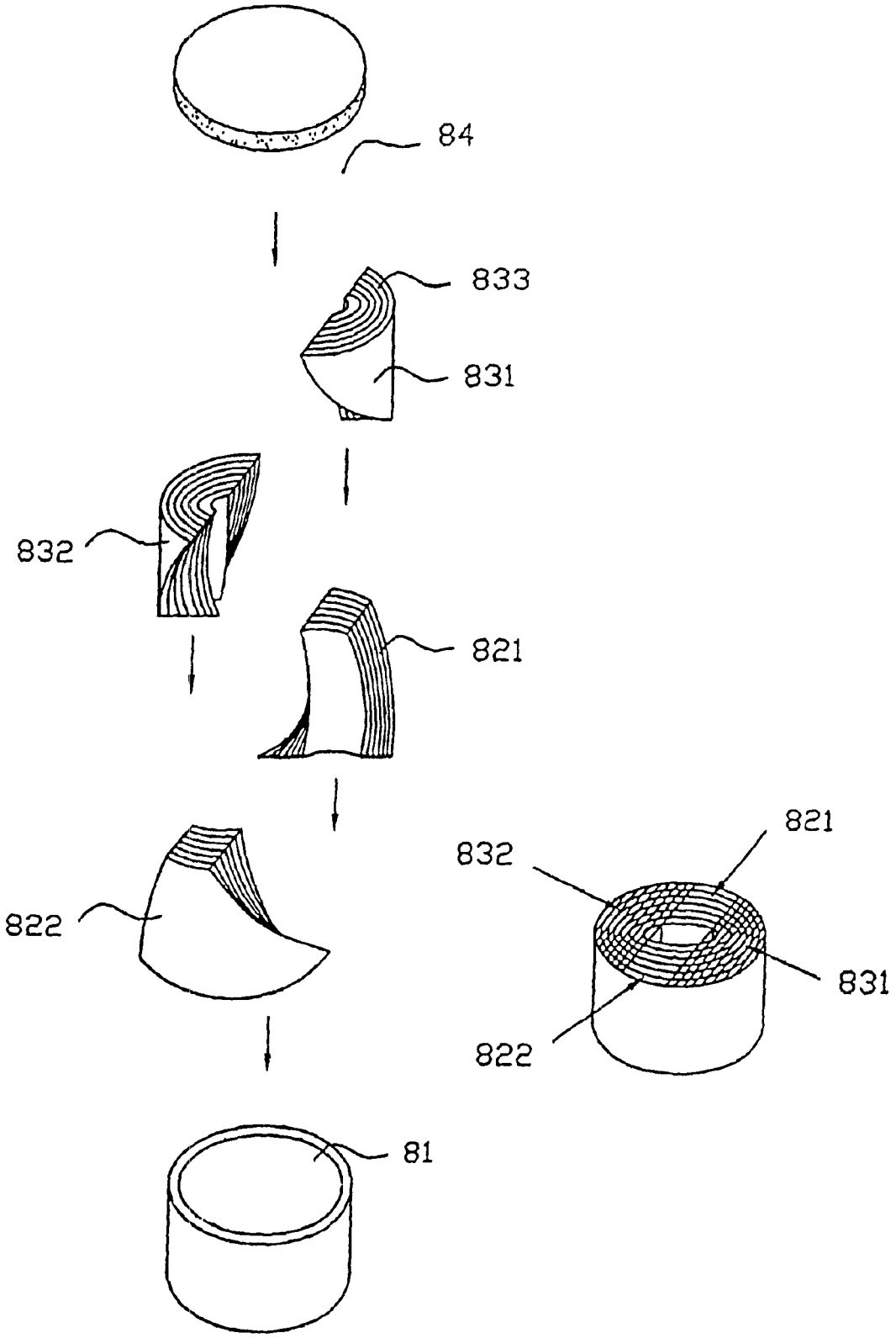
FIG. 5 is a perspective schematic diagram of the contact structure of the first preferred embodiment of the invention.
Figure 6:
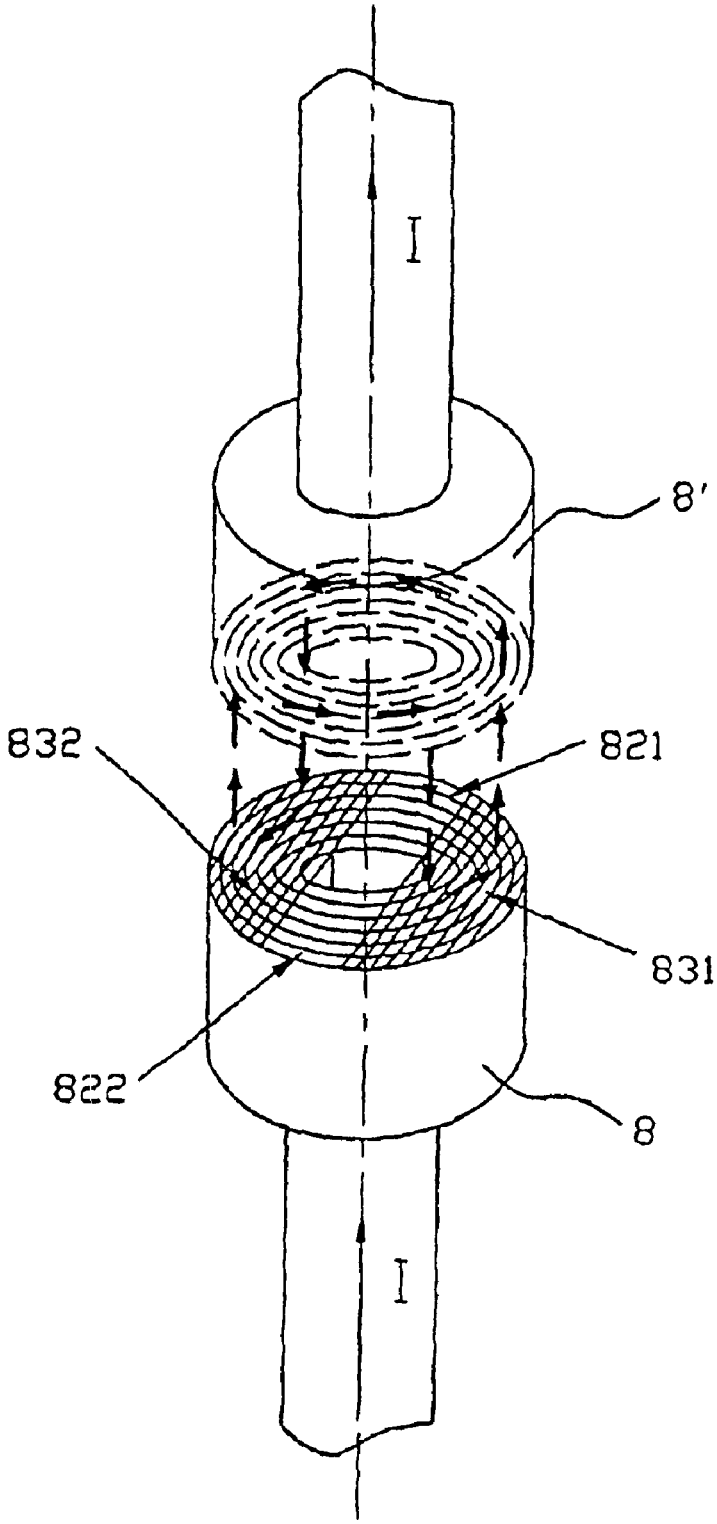
FIG. 6 is a magnetic loop diagram of the axial magnetic field shown in FIG. 5.
Figure 7:
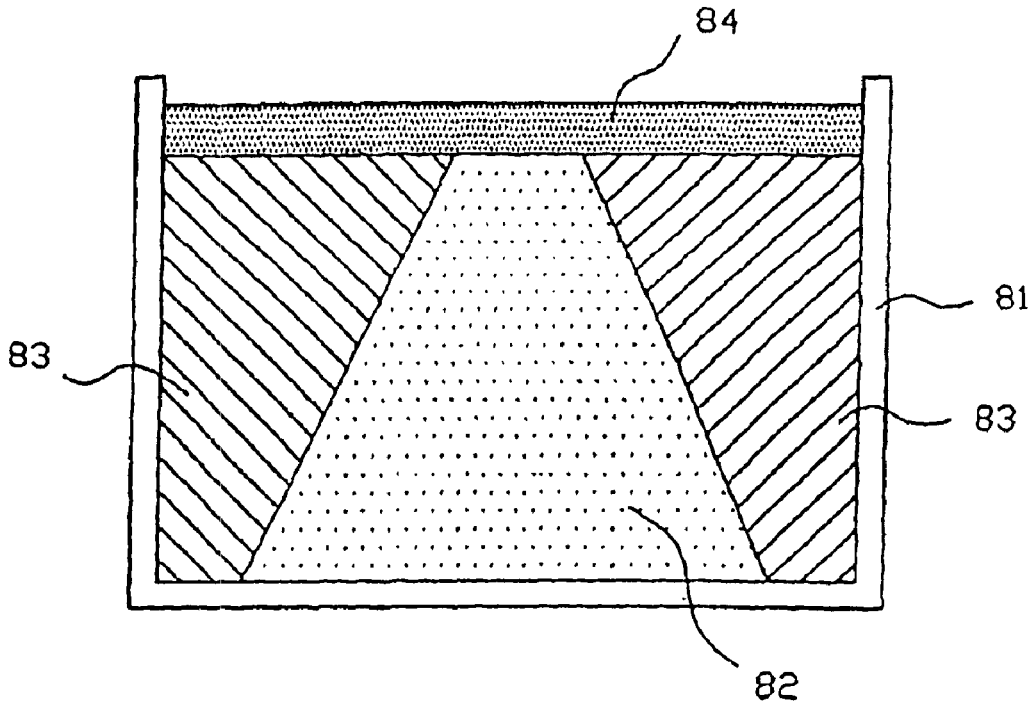
FIG. 7 is a schematic central section diagram of the cylinder setting combining structure of the magnetic field generating component and the conductive component shown in FIG. 5.
Figure 8:
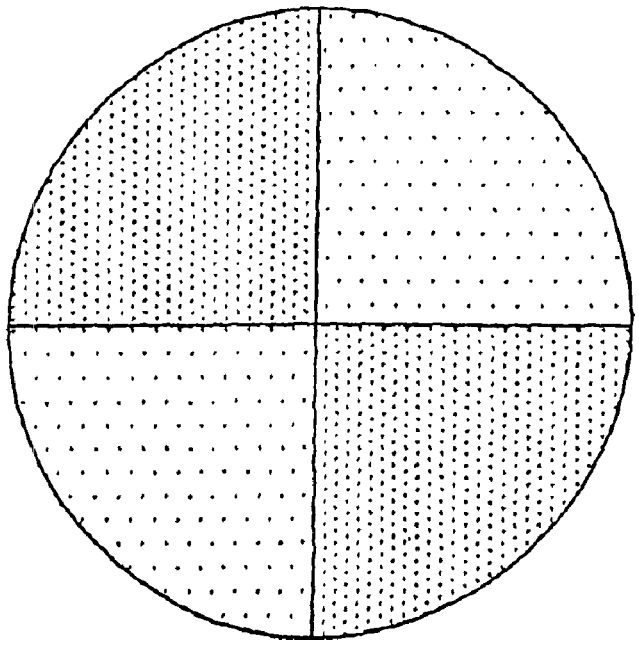
FIG. 8 is an axial magnetic field distribution diagram on the contact surfaces of the embodiments shown in FIG. 5, FIG. 6 and FIG. 7.

FIGS. 5–8, show a schematic diagram of a structure according to various embodiments of the invention. Specifically, an arc proof component 84, a conductive component 821, 822, and a magnetic field generating component 831, 832 of contact 8 are set in a cup-like body container 81 with an open top. The conductive component 821, 822, and the magnetic field generating component 831, 832 are combined and set at the bottom of the cup-like body container 81, and the arc proof component 84 is set on top of the combination of conductive component 82 and magnetic field generating component 831, 832. The shape of the combination of magnetic field generating component 831, 832 and conductive component 821, 822 is coordinated with the cylinder shape of the cup-like body container 81. As shown in FIG. 6 and FIG. 8, according to the right-handed screw law, when the conductive component 821, 822 has current flowing, the magnetic field generating component 831, 832 produces a magnetic field, axial magnetic flux of that comes in and goes out of the contact surface multiple times, i.e. the magnetic flux forms close loops, which come in and go out of the contact placed oppositely multiple times. Therefore, the magnetic field is well distributed on the contact surface, and the contact is suitable to interrupt a high volume of current.

In this embodiment, front sections of the conductive component 821, 822 and the magnetic field generating component 831, 832 are trapeziums in shape. The trapeziums shape of conductive component 821, 822 and trapezium shape of the magnetic field generating component 831, 832 are mutually coordinated, the combination of them is corresponds to the cylinder shape body of the cup-like container.

Conductive component 821, 822 passes through the center of the cup-like body 81, and equally divides the cup-like body 81 into two halves, left and right; magnetic field generating component 831, 832 is isolated by conductive component 821, 822 and is set in the remaining part of the cup-like body 81. In this embodiment, the conductive component 821, 822 is a combined structure of multiple cylinders with different diameters, and a cylinder body is set at the center of cylinders for insertion into a central through-hole of the magnetic field generating component. The magnetic field generating component 831, 832 can be a multi-layer combined cylinder body structure 833 with different diameters isolation between the layers. Multiple cylinder body 833 can have one layer of soft magnetic material, or more than one layer of soft magnetic material or all layers of soft magnetic material, to produce different required magnetic field intensities. In one embodiment, the number of layers in the multi-layer cylinder of the magnetic field generating component 831, 832 is equals to the number of layers in the multi-layer cylinder of the conductive component 821, 822. In addition, the conductive component 821, 822 can also be an entire entity. Furthermore, at the contact top position, a width of the conductive component 821, 822 can be greater than a real electromagnetic physical gap between two contacts placed oppositely in interrupter, to guarantee axial magnetic field intensity between two contacts.

Figure 9:
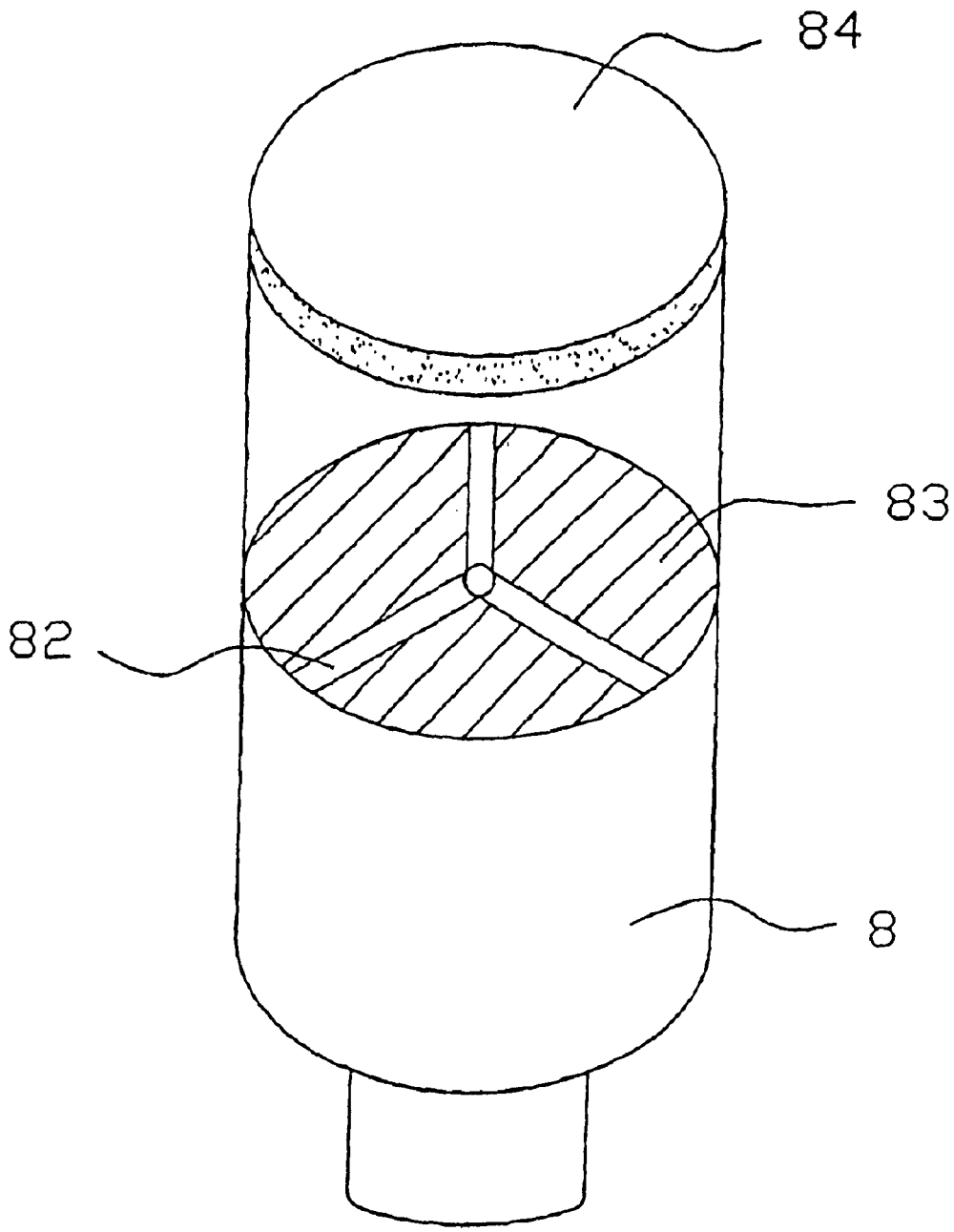
FIG. 9 is a schematic diagram of the contact structure of the second embodiment of the invention.
Figure 10:
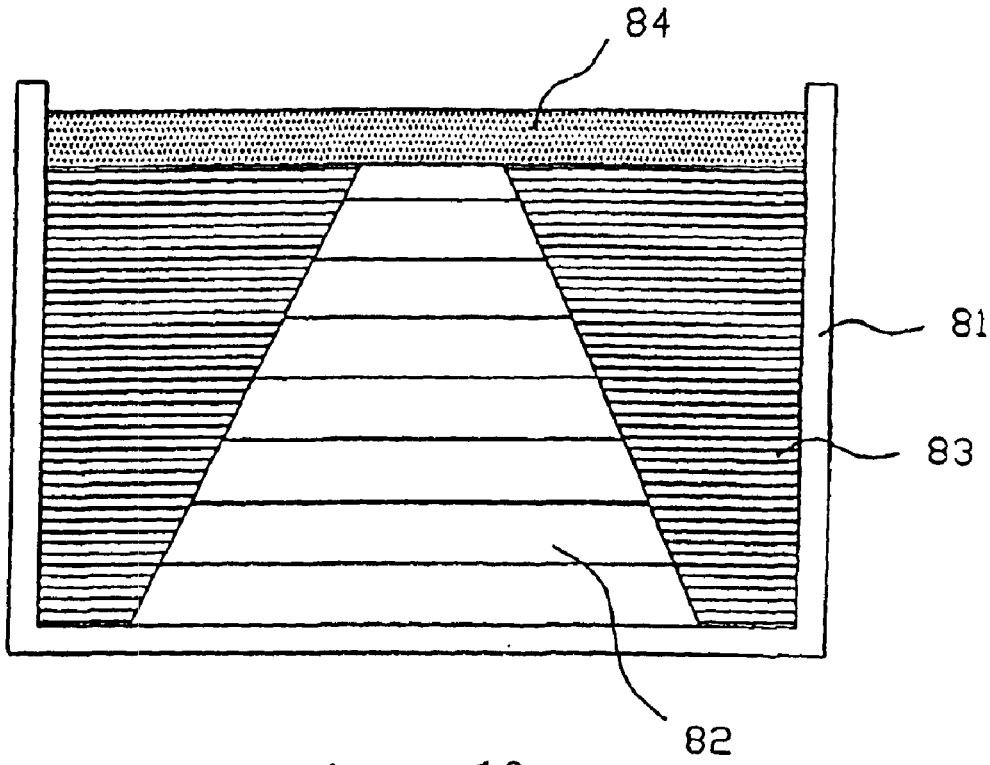
FIG. 10 is a schematic central section diagram of the layer setting combining structure of the magnetic field generating component and the conductive component of the embodiment shown in FIG. 9.
Figure 11:
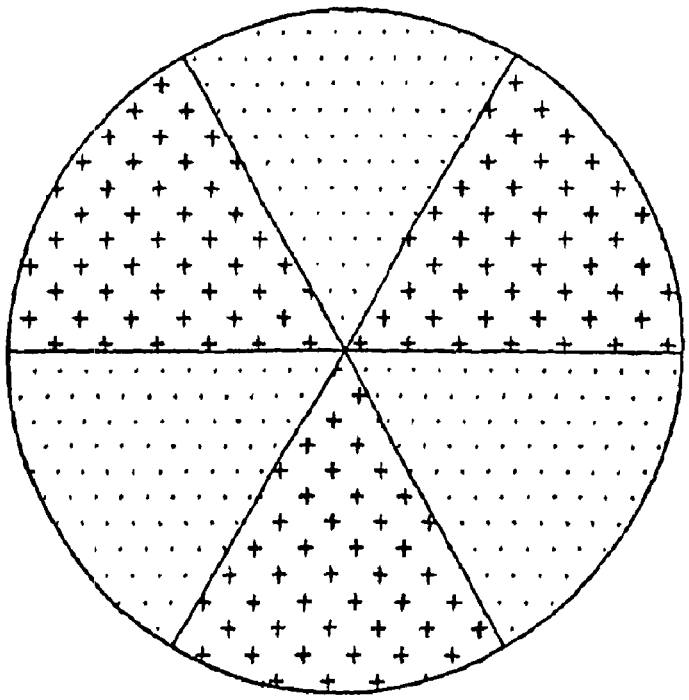
FIG. 11 is an axial magnetic field distribution diagram on the contact surfaces of the embodiments shown in FIG. 9 and FIG. 10.

With reference to FIGS. 9–11, in another embodiment, a conductive component 82 is set at the middle of a cup-like body container 81; and from top to bottom, the cup-like body container 81 is equally divided into three parts by the conductive component 82. A magnetic field generating component 83 and the conductive component 82 are combined, each having a trapezium shape; wherein the conductive component 82 and the magnetic field generating component 83 are piled layer by layer with one layer or more than one layer; each layer of the conductive component 82 and each layer of the magnetic field generating component 83 are mutually combined. From bottom to top, the area of each layer of the conductive component 82 is gradually decreased and the area of each layer of the corresponding magnetic field generating component 83 is gradually increased. After mutually combining the conductive component 82 and the magnetic field generating component 83, the combined shape is coordinated with the inner wall shape of cup-like body container 81, and arc proof component 84 is set at top of the combination. According to the right-handed screw law, when current passes through conductive component 82, the magnetic field generating component 83 produces a magnetic field, axial magnetic flux of that three times coming in and three times going out on contact surface, i.e. magnetic flux forms magnetic field close loops with three times coming in and going out of the contact placed oppositely. Therefore, on the contact surface, the magnetic field is well distributed and powerful, and is suitable to interrupt a high volume of current.

Every component of the invention can be made from various materials with various states. For example, a material of conductive component 82 can be conductive with respect to electric and heat, and high magnetic resistance, such as copper, its state can be powder, sheet, bar, tube or block; the material used for the magnetic field generating component 83 can be partly or totally soft magnetic material, such as electrical iron. Part of the magnetic field generating component 83 state can be powder, sheet, bar, tube or block. The state of the soft magnetic material can be powder, sheet, bar, tube or block.

According to the structure and the design of the invention, the production process of the interrupter contact can be simplified, entering the furnace once to seal and complete the whole assembly. In addition, there is no need for a soldering process; this saves solder and increases the reliability of component connection and increases the quality of the product.

The integrated structure as shown in the previous embodiments of the present invention packs all contact components into a container. The meaning of this improvement is comparable with an electronic circuit improved from separated elements to an integrated circuit. The whole-integrated structure thoroughly changes the separated setting structure of the current technology, it tightens geometric size, shrinks volume and increases current density.

Embodiments of the present invention, disclosed herein, expands the types of magnetic field generating component and conductive component, that can be used and also makes use of powder materials, and uncertain shape materials, as there is an external packing container. Therefore, various embodiments of the present invention greatly expand the range of general materials that can be used in contacts for vacuum interrupters.

Magnetic flux is efficiently generated, magnetic resistance is low, axial magnetic field intensity is very high and well distributed; magnetic flux comes in and goes out on the contact surface many times and forms its own close loop; and it can better avoid the influence of external stray magnetic fields on the interrupting capability of the contacts; the arc is well controlled and in a diffusion state; contributing to an increase in the interrupting capability.

As sections of the magnetic field generating component and the conductive component are mutually combined; heat conductivity efficiency increases, which raises the interrupting capability, and also solves the damage problem of the contact body caused by deformation due to asymmetry of the heat contactor in the current technology, and it also saves materials, as every cut component can be combined with another corresponding component, reducing leftover bits and pieces during manufacturing.

Component materials need not be restricted to an alloy with a certain ratio of CuCr manufactured specially for a contact, and need not be in a special shape for components, but general copper, iron and rustless steel sections available in the market can be used. This makes manufacturing easy and decreases cost.

The structure of every component is simple and easy to process and assemble. With entering furnace once and sealing once, the whole assemble is completed with high product ratio of up to standard. Soldering processes are not needed; this not only saves solder, but also guarantees connection reliability of the components.

It will be apparent to those skilled in the art that various modifications can be made without departing from the scope and spirit of the present invention. It is intended that the present invention covers modifications and variations of the systems and methods provided they fall within the scope of the claims and their equivalents. Further, it is intended that the present invention cover present and new applications of the system and methods of the present invention.

I claim:

1. A multipolar integrated contact, comprising:

an arc proof component;

a conductive component;

a magnetic field generating component; and a container having an open top, a bottom and a center, wherein the arc proof component, the conductive component and the magnetic field generating component are set in the container, the conductive component passes through the center of the container and divides the container into several parts along a direction from the top to the bottom; the magnetic field generating component comprises separate portions isolated by the conductive component, each separate portion of the magnetic field generating component is combined with the conductive component and fills in one of the several parts within the container, and the arc proof component is on top of the combination of the magnetic field generating component and the conductive component.

2. The multipolar integrated contact, as in claim 1, wherein the conductive component divides the container into two substantially equal parts.

3. The multipolar integrated contact, as in claim 2, wherein a front direction section of the conductive component and a front direction section of the magnetic field generating component have a trapezium shape, and the conductive component's trapezium shape and magnetic field generating component's trapezium shape are mutually coordinated.

4. The multipolar integrated contact, as in claim 1, wherein the container has a cylindrical inner sidewall and the conductive component and the magnetic field generating component are combined to form a cylindrical body conforming with the cylindrical inner sidewall of the container, wherein each separate portion of the magnetic field generating component comprises a plurality of cylindrical-shape layers with different diameters arranged substantially parallel with the cylindrical inner sidewall of the container, at least one layer of the magnetic field generating component is a soft magnetic material layer.

5. The multipolar integrated contact, as in claim 4, wherein the conductive component comprises a plurality of cylindrical-shape layers with different diameters arranged substantially parallel with the cylindrical inner sidewall of the container.

6. The multipolar integrated contact, as in claim 5, wherein a number of layers of the magnetic field generating component and is equal to a number of layers of the conductive component.

7. The multipolar integrated contact, as in claim 1, wherein each separate portion of the magnetic field generating component comprises a plurality of layers stacked over each other from the bottom to the top of the container.

8. The multipolar integrated contact, as in claim 7, wherein the conductive component comprises a plurality of layers stacked over each other from the bottom to the top of the container.

9. The multipolar integrated contact, as in claim 8, wherein a number of the layers in each separate portion of the magnetic field generating component equals to a number of the layers of the conductive component.

10. The multipolar integrated contact, as in claim 1, wherein the container is a cup-like body made of stainless steel with a melting point higher than eleven hundred (1,100) degree Centigrade.

11. The multipolar integrated contact, as in claim 1, wherein the arc proof component is made from a mixture of copper powder and chromium powder and a ratio of the mixture of copper powder and chromium powder can be varied from 10:90 to 90:10.

12. The multipolar integrated contact, as in claim 1, wherein the arc proof component is made from a sheet or a block of copper chromium alloy.

13. The multipolar integrated contact, as in claim 1, wherein the conductive component is made of copper and a material state of the conductive component is selected from the group consisting of powder, sheet, bar, tube, and block.

14. The multipolar integrated contact, as in claim 6, wherein the soft magnetic material is electrical iron and a material state of the soft magnetic material is selected from the group consisting of powder, sheet, bar, tube, and block.

15. The multipolar integrated contact, as in claim 1, wherein the conductive component divides the container into three substantially equal parts.

16. The multipolar integrated contact, as in claim 1, wherein a cross sectional area of the conductive component decreases from the bottom to the top of the container, and a cross sectional area of the magnetic field generating component increases from the bottom to the top of container.

17. The multipolar integrated contact, as in claim 1, wherein the container has a cylindrical inner sidewall, the conductive component and the magnetic field generating component are combined to form a cylindrical body with a diameter slightly smaller than a diameter of the cylindrical inner sidewall of the container, so that the cylindrical body is well fitted with the cylindrical inner sidewall, and wherein the conductive component passes through a central axis of the cylindrical inner sidewall from the top to the bottom of the container.

18. A multipolar integrated contact, comprising:

an arc proof component;

a conductive component;

a magnetic field generating component; and a container having an open top, a bottom, and a cylindrical inner sidewall, wherein the conductive component and the magnetic field generating component are set in the container and combined to form a cylindrical body with an axial through hole, the conductive component comprises at least two separate equal pieces with each piece fully extending from a bottom to a top of the cylindrical body, the magnetic field generating component comprises at least two separate equal pieces with each piece fully extending from the bottom to the top of the cylindrical body, and each piece of the magnetic field generating component are isolated by the conductive component, the arc proof component is on top of the cylindrical body; and wherein a cross sectional area of the conductive component in the cylindrical body decreases from the bottom to the top of the cylindrical body, and a cross sectional area of the magnetic field generating component in the cylindrical body increases from the bottom to the top of the cylindrical body.

* * * * *